US011395077B2

(12) United States Patent
Hamaguchi

(10) Patent No.: US 11,395,077 B2
(45) Date of Patent: Jul. 19, 2022

(54) HEARING DEVICE WITH VENT

(71) Applicant: GN HEARING A/S, Ballerup (DK)

(72) Inventor: Ippei Hamaguchi, Oiso-machi (JP)

(73) Assignee: GN HEARING A/S, Ballerup (DK)

( * ) Notice: Subject to any disclaimer, the term of this patent is extended or adjusted under 35 U.S.C. 154(b) by 67 days.

(21) Appl. No.: 16/786,547

(22) Filed: Feb. 10, 2020

(65) Prior Publication Data

US 2020/0288254 A1 Sep. 10, 2020

(30) Foreign Application Priority Data

Mar. 8, 2019 (EP) ..... 19161683

(51) Int. Cl.
*H04R 25/00* (2006.01)

(52) U.S. Cl.
CPC ..... *H04R 25/652* (2013.01); *H04R 25/658* (2013.01); *H04R 2225/025* (2013.01)

(58) Field of Classification Search
CPC combination set(s) only.
See application file for complete search history.

(56) References Cited

U.S. PATENT DOCUMENTS 5,487,012 A * 1/1996 Topholm ..... H04R 25/652 700/163
5,654,530 A 8/1997 Sauer et al.
6,339,648 B1 * 1/2002 McIntosh ..... A61F 11/08 381/328
6,863,151 B2 3/2005 Widmer et al.
7,424,122 B2 * 9/2008 Ryan ..... H04R 25/456 381/322
7,694,418 B2 * 4/2010 Topholm ..... B33Y 50/02 29/896.21
8,265,316 B2 * 9/2012 Saltykov ..... H04R 25/456 381/325
10,021,472 B2 * 7/2018 Cabrera ..... H04R 1/1016
(Continued)

FOREIGN PATENT DOCUMENTS

EP 1906699 4/2008
JP 2008199193 * 8/2008
(Continued)

OTHER PUBLICATIONS

Extended European Search Report for EP Patent Appln. No. 19161683.8 dated Aug. 19, 2019.

*Primary Examiner* — Angelica M McKinney
(74) *Attorney, Agent, or Firm* — Vista IP Law Group, LLP

(57) ABSTRACT

An earpiece housing includes: an ear canal part to be introduced into an ear canal of a user, wherein the ear canal part extends along an ear canal axis of the earpiece, the ear canal part having a first end configured to be positioned in the ear canal of the user; a first protrusion with a first outer surface; and a second protrusion with a second outer surface; and an intermediate space between the first protrusion and the second protrusion; wherein the first protrusion is between the first end of the ear canal part and the second protrusion along the ear canal axis, the first protrusion comprising a first channel part configured to provide fluid communication between an ear canal cavity and the intermediate space, the second protrusion comprising a second channel part configured to provide fluid communication between the intermediate space and a surrounding of the user.

31 Claims, 7 Drawing Sheets

(56) References Cited

U.S. PATENT DOCUMENTS

| | | | | |
|---|---|---|---|---|
| 10,129,668 | B2 * | 11/2018 | Anderson | H04R 25/652 |
| 2004/0107080 | A1 * | 6/2004 | Deichmann | H04R 25/658<br>703/6 |
| 2010/0086158 | A1 * | 4/2010 | Oberlander | H04R 25/652<br>381/328 |
| 2011/0223864 | A1 * | 9/2011 | Wai | H04R 25/656<br>455/41.3 |
| 2012/0257774 | A1 * | 10/2012 | Larsen | H04R 25/656<br>381/328 |
| 2016/0066110 | A1 * | 3/2016 | Shennib | H04R 25/652<br>381/328 |

FOREIGN PATENT DOCUMENTS

| | | | | |
|---|---|---|---|---|
| JP | 2008199193 | A | * | 8/2008 |
| JP | 2009027317 | | | 2/2009 |
| JP | 4925849 | B2 | | 5/2012 |
| WO | WO 0105207 | A2 | | 1/2001 |
| WO | WO 0143499 | | | 6/2001 |
| WO | WO 0105207 | A3 | | 12/2001 |
| WO | WO 2008148585 | | | 12/2008 |

* cited by examiner

HEARING DEVICE WITH VENT

RELATED APPLICATION DATA

This application claims priority to, and the benefit of, European Patent Application No. 19161683.8 filed on Mar. 8, 2019. The entire disclosure of the above application is expressly incorporated by reference herein.

FIELD

The present disclosure relates to an earpiece for a hearing device and a related method of manufacturing an earpiece of a hearing device.

BACKGROUND

Occlusion has for long been recognised as a problem for some hearing device users, and continuous efforts have been made to reduce the occlusion effect. Known solutions to reduce the occlusion effect provide a vent in the earpiece of the hearing device, e.g. between the tip of the hearing device and the faceplate along the front of the hearing device, in order to allow pressure equalization between the ear canal and the surroundings. However, simply providing a vent in the earpiece does not necessarily reduce occlusion to a level acceptable to all of the hearing device users.

In order to optimise the reduction of occlusion, the hearing device may be designed to have a shorter vent (e.g. by making a step vent) or to have a loose fitting/mount in the ear canal. However, by making the vent shorter or by loosening the fitting, the stability of the hearing device in the ear canal is reduced. On the other hand, in order to increase the stability of the hearing device in the ear canal, the hearing device may be designed so that the contact area between the hearing device and the ear canal wall is increased, which however results in an increase in occlusion and in that the user may feel that the hearing device is bulky in the ear canal.

SUMMARY

Accordingly, there is a need for an ear piece for a hearing device and methods of manufacturing an earpiece of a hearing device, which optimises wear comfort without compromising the stability of the hearing device in the ear canal of the user and while providing satisfactory occlusion and/or audio feedback reducing properties.

An earpiece for a hearing device is disclosed, the earpiece comprising an earpiece housing comprising: an ear canal part to be introduced into the ear canal of a user, the earpiece configured to form an ear canal cavity between the tympanic membrane of the ear canal and the earpiece housing when inserted into the ear canal of the user, where the ear canal part extends along an ear canal axis of the earpiece, the ear canal part having a first end configured to be positioned in the ear canal of the user; a first protrusion with a first outer surface; a second protrusion with a second outer surface; and an intermediate cavity arranged between the first protrusion and the second protrusion, wherein the first protrusion is arranged between the first end of the ear canal part and the second protrusion along the ear canal axis, the first protrusion comprising a first channel part providing fluid communication between the ear canal cavity and the intermediate cavity, and the second protrusion comprising a second channel part providing fluid communication between the intermediate cavity and surroundings of the user.

Further, a method of manufacturing an earpiece of a hearing device is provided, the method comprising: obtaining a model of the ear canal of the user; designing an earpiece housing member based on the model of the ear canal; removing a part of the earpiece housing member to form a first protrusion, a second protrusion, and an intermediate cavity in the earpiece housing member; moulding the earpiece housing member.

It is an important advantage of the earpiece of the hearing device that occlusion of the ear of the user is reduced without compromising the stability of the earpiece in the ear canal of the user. The present disclosure provides a modelling design that results in an improved balance between reduced occlusion and a stable and comfortable fit for the end user.

Further, the present disclosure provides a reduction in surface area of the earpiece in contact with the ear canal wall, which leads to less pressure being exerted on the ear canal wall and a more comfortable fitting/mounting of the earpiece of the hearing device in the ear canal of the user. The present disclosure may be useful for hearing device user with straight ear canals.

An earpiece for a hearing device includes an earpiece housing, the earpiece housing comprising: an ear canal part to be introduced into an ear canal of a user, wherein the ear canal part extends along an ear canal axis of the earpiece, the ear canal part having a first end configured to be positioned in the ear canal of the user; a first protrusion with a first outer surface; and a second protrusion with a second outer surface; and an intermediate space between the first protrusion and the second protrusion; wherein the first protrusion is between the first end of the ear canal part and the second protrusion along the ear canal axis, the first protrusion comprising a first channel part configured to provide fluid communication between an ear canal cavity and the intermediate space, the second protrusion comprising a second channel part configured to provide fluid communication between the intermediate space and a surrounding of the user.

Optionally, the first outer surface is configured to contact a wall of the ear canal of the user when the earpiece is inserted into the ear canal of the user.

Optionally, the second outer surface is configured to contact a wall of the ear canal of the user when the earpiece is inserted into the ear canal of the user.

Optionally, the first channel part has a first diameter in a range of 0.5 mm to 5 mm, and the second channel part has a second diameter in a range of 0.5 mm to 5 mm, and wherein the second diameter is larger than the first diameter.

Optionally, the first channel part has a first length in a range of 1 mm to 5 mm.

Optionally, the second channel part has a second length in a range of 1 mm to 5 mm.

Optionally, the intermediate space has a length in a range of 3 mm to 10 mm.

Optionally, a length of the intermediate space is larger than a length of the first channel part.

Optionally, a length of the intermediate space is larger than a length of the second channel part.

Optionally, a length of the intermediate space is larger than a sum of a length of the first channel part and a length of the second channel part.

Optionally, the first channel part has a first primary opening directed towards the ear canal cavity, the first primary opening comprising a first rounded edge, and the second channel part has a second secondary opening directed towards the intermediate space, the second secondary opening comprising a second rounded edge.

Optionally, the intermediate space is at least partially defined by an outer surface of the earpiece housing.

Optionally, the first protrusion is at a first distance from the first end, wherein the first distance is in a range from 0.5 mm to 4.0 mm.

Optionally, the ear canal cavity is between a tympanic membrane and the earpiece housing when the earpiece is inserted into the ear canal of the user.

A method of manufacturing an earpiece of a hearing device includes: obtaining a model of an ear canal of a user; determining a configuration of an earpiece housing member to be formed based on the model of the ear canal, wherein the earpiece housing member to be formed comprises a first protrusion, a second protrusion, and an intermediate space between the first protrusion and the second protrusion; forming the earpiece housing member based on the determined configuration; forming a first channel part in the first protrusion; and forming a second channel part in the second protrusion.

Optionally, the act of forming the earpiece housing member comprises molding the earpiece housing member.

Optionally, the act of determining the configuration of the earpiece housing member to be formed comprises: determining a model for the earpiece housing member; and removing a part of the model to define a configuration of the first protrusion and a configuration of the second protrusion.

Other features will be described in the detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
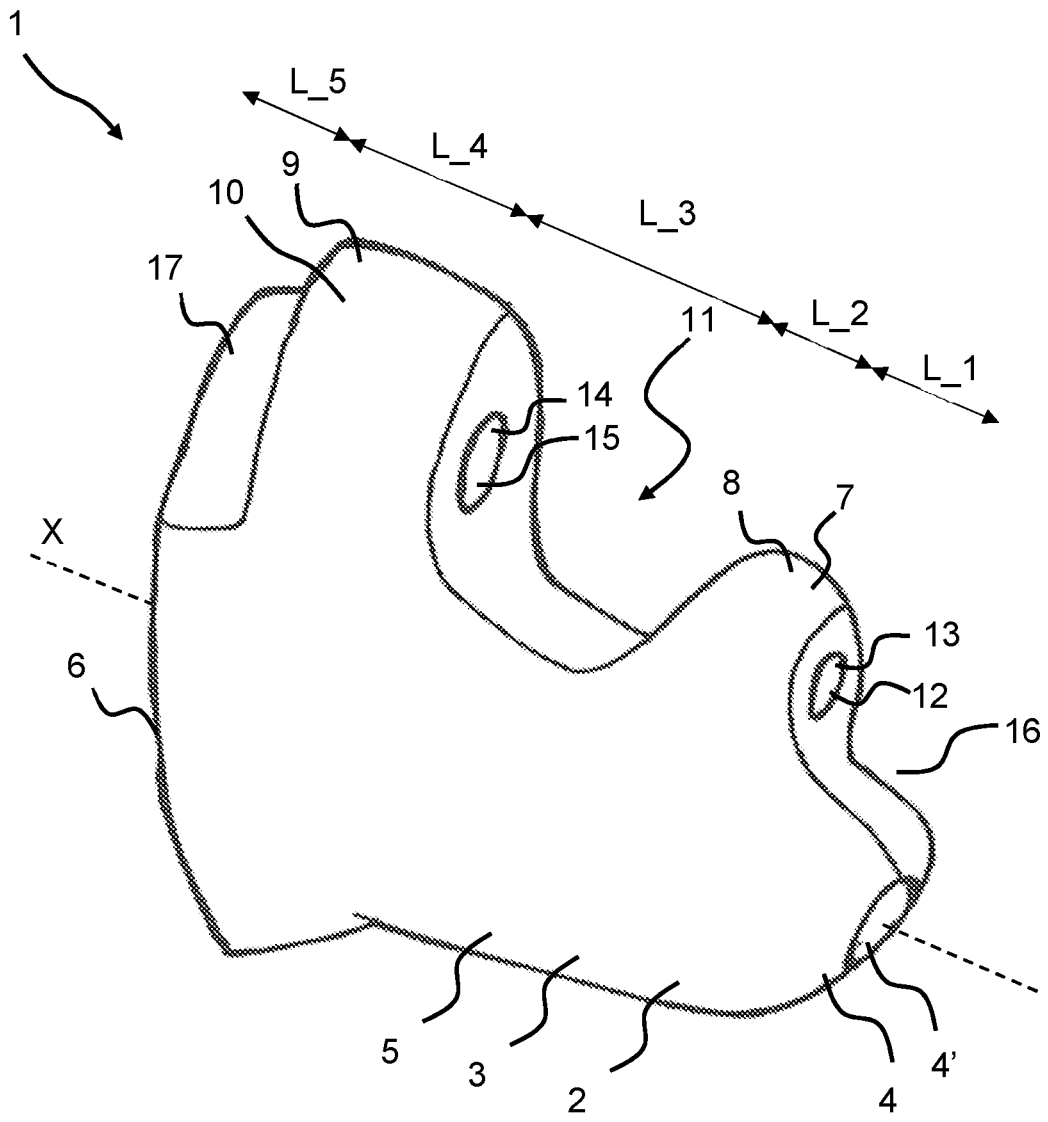
FIG. 1 illustrates an exemplary earpiece of a hearing device.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

As a general rule, in order to reduce occlusion, the hearing device (or earpiece of a hearing device) could be modelled by increasing the vent diameter, shortening the overall vent by using a step vent, or designing an overall looser fitting of the hearing device. However, the trade-offs are an increased risk of howling or making the hearing device uncomfortable for the end user, giving the sensation that the device is unstable in the ear or likely to fall out. There is also a limit to how large you can make the vent.

A vent may refer to a hole (or two or more connected holes) drilled or otherwise formed completely through the hearing device (or earpiece of a hearing device) from an outer surface to an inner surface of the hearing device. A vent is designed to provide some reduction of amplified low frequency sound, i.e. to allow low frequency sounds to leak out of the ear canal of the user. Hereby, some of the low frequency sounds amplified by the hearing device will not be transmitted through the middle ear and into the inner ear. Instead, the amplified low frequency sounds in the ear canal will find that the acoustical path of least resistance is out through the vent hole and into the atmosphere, rather than through the middle ear.

Therefore, providing a vent in a hearing device may have the advantage of reducing unnecessary low frequency gain and output from the ear canal/eardrum, allowing unamplified sound to enter the ear canal, reducing the occlusion effect, relieving the feeling of pressure in the ear, and reducing moisture build-up in the ear canal.

A typical vent stretches from the tip (first end) of the earpiece to the faceplate along the front of the hearing device. One alternative is to shorten the vent by using a step vent design. The drawback with this design is that while it can reduce occlusion, the hearing device has a less stable fit inside the ear as the area in contact with the ear canal is reduced. The tip of the hearing device is more free to move and gives the sensation that the hearing device is unstable in the ear.

Reducing the occlusion of the ear of the user, may refer to reducing the acoustic mass or acoustic impedance of a vent. The acoustic mass of a vent may be determined by:

$$\text{Acoustic mass}=\rho\cdot(l/s)$$

where ρ is the acoustic pressure, l is the length of the vent, and s is the size of the cross-sectional area of the vent. Therefore, to reduce the acoustic mass (or the acoustic impedance), either the length of vent can be reduced or the cross-sectional area of the vent can be increased.

An earpiece for a hearing device is disclosed. The hearing device may be a hearable or a hearing aid, wherein the processor is configured to compensate for a hearing loss of a user.

The hearing device may be of the behind-the-ear (BTE) type, in-the-ear (ITE) type, in-the-canal (ITC) type, receiver-in-canal (RIC) type or receiver-in-the-ear (RITE) type. The hearing aid may be a binaural hearing aid. The hearing device may comprise a first earpiece and a second earpiece, wherein the first earpiece and/or the second earpiece is an earpiece as disclosed herein.

The earpiece comprises an earpiece housing. An earpiece housing may refer to a shell, container, casing, etc. forming a cavity/opening, which partly or completely encloses one or more elements of the hearing device. An earpiece housing may comprise an outer surface.

The earpiece housing comprises an ear canal part. The ear canal part may be configured to be introduced into the ear canal of a user. The ear canal part may comprise an outer surface, which may be at least part of an outer surface of the earpiece housing. At least part of the outer surface of the ear canal part may be configured to contact the ear canal wall of the user, when the earpiece is inserted into the ear canal of the user. Thus, providing an ear canal part at least partly contacting/touching the ear canal wall may ensure that the earpiece, and thereby the hearing device, may be inserted and mounted/fixed (in a releasable manner) in the ear canal of the user. In other words, the size and contour of the contact areas between the ear canal part (e.g. the outer surface) and the ear canal wall may ensure that they are fixed relative to each other by way of frictional force and/or engagement.

The earpiece is configured to form an ear canal cavity between the tympanic membrane of the ear canal and the earpiece housing when the earpiece is inserted into the ear canal of the user. Advantageously, the earpiece housing is configured to extend inside the ear canal to a degree so that the ear canal cavity may be minimized. Thereby, the effect of a receiver of the hearing device generating sound waves in the ear canal cavity is increased.

The ear canal part extends along an ear canal axis of the earpiece. The ear canal axis may extend from the end of the earpiece housing positioned proximate the tympanic membrane of the user, to the end of the housing position at the faceplate of the hearing device. The hearing device/earpiece may be inserted into the ear canal of the user along the ear canal axis of the earpiece. The ear canal part has a first end configured to be positioned in the ear canal of the user.

The earpiece housing comprises a first protrusion with a first outer surface. The earpiece housing comprises a second protrusion with a second outer surface. A protrusion may refer to a feature which protrudes/extends away from the part of the earpiece housing positioned in the immediate vicinity of the protrusion. A protrusion may have a shape in the form of a cone, or ridge. A protrusion may extend in a direction parallel and/or orthogonal to the ear canal axis.

The earpiece housing comprises an intermediate cavity arranged between the first protrusion and the second protrusion. An intermediate cavity may refer to an opening, volume, or aperture defined by an inner and/or outer surface of the earpiece housing. The intermediate cavity may be enclosed, i.e. the intermediate cavity may be defined by an inner surface of the earpiece housing. In one more exemplary earpieces, the intermediate cavity may be at least partly defined or enclosed by an outer surface of the earpiece housing. For example, the intermediate cavity may be enclosed by the first protrusion, the second protrusion and an inner surface (or an outer surface) of the earpiece housing. Alternatively, the intermediate cavity may be partly enclosed, e.g. by the first protrusion and/or the second protrusion. The intermediate cavity may provide an intermediate cross-sectional area between the first and second protrusion being larger than the cross-sectional area of the first and/or second channel part.

The first protrusion is arranged between the first end of the ear canal part and the second protrusion along the ear canal axis. In other words, relative to the ear canal axis, the first protrusion is arranged closest to the first end of the ear canal part followed by the intermediate cavity and the second protrusion.

The first protrusion comprises a first channel part providing fluid communication between the ear canal cavity and the intermediate cavity. The first channel part may be a through-going bore. A through-going bore reduces the risk of the channel part being clogged e.g. by ear wax, compared to if the channel part is an open channel, such as a groove. The first channel part may be a groove, which facilitates easy manufacturing. The first channel part may extend linearly, e.g. parallel or slightly angled, with the ear canal axis. The first channel part may extend with an angle relative to the ear canal axis, e.g. with an angle less than 45 degrees. A linearly extending channel part facilitates easy manufacturing. The first channel part may extend in a non-linear manner. For example, the channel part may extend in a curvilinear, bend or angled manner.

The second protrusion comprises a second channel part providing fluid communication between the intermediate cavity and surroundings of the user. The second channel part may be a through-going bore. A through-going bore reduces the risk of the channel part being clogged e.g. by ear wax, compared to if the channel part is an open channel, such as a groove. The second channel part may be a groove, which facilitates easy manufacturing. The second channel part may extend linearly, e.g. parallel or slightly angled, with the ear canal axis. The second channel part may extend with an angle relative to the ear canal axis, e.g. with an angle less than 45 degrees. A linearly extending channel part facilitates easy manufacturing. The second channel part may extend in a non-linear manner. For example, the channel part may extend in a curvilinear, bend or angled manner.

For example, a middle section of the earpiece is removed to form the intermediate cavity. This has the same effect as shortening the vent and helps to reduce occlusion. By leaving areas of contact with the ear canal near both the first end (first protrusion) and the faceplate side (second protrusion), the hearing device (e.g. the earpiece) remains more balanced within the ear and the fit does not lose stability. With less total area in contact with the ear, the end user does not feel that the hearing device is bulky in the ear, and at the same time gets the benefit of reduced occlusion when wearing the hearing device.

The hearing device may be configured for wireless communication with one or more devices, such as with another hearing device, e.g. as part of a binaural hearing system, and/or with one or more accessory devices, such as a smartphone and/or a smart watch. The hearing device optionally comprises an antenna for converting one or more wireless input signals, e.g. a first wireless input signal and/or a second wireless input signal, to antenna output signal(s). The wireless input signal(s) may origin from external source(s), such as spouse microphone device(s), wireless TV audio transmitter, and/or a distributed microphone array associated with a wireless transmitter. The wireless input signal(s) may origin from another hearing device, e.g. as part of a binaural hearing system, and/or from one or more accessory devices.

The hearing device optionally comprises a radio transceiver coupled to the antenna for converting the antenna output signal to a transceiver input signal. Wireless signals from different external sources may be multiplexed in the radio transceiver to a transceiver input signal or provided as separate transceiver input signals on separate transceiver output terminals of the radio transceiver. The hearing device may comprise a plurality of antennas and/or an antenna may be configured to be operate in one or a plurality of antenna modes. The transceiver input signal optionally comprises a first transceiver input signal representative of the first wireless signal from a first external source.

The hearing device comprises a set of microphones. The set of microphones may comprise one or more microphones. The set of microphones comprises a first microphone for provision of a first microphone input signal and/or a second microphone for provision of a second microphone input signal. The set of microphones may comprise N microphones for provision of N microphone signals, wherein N is an integer in the range from 1 to 10. In one or more exemplary hearing devices, the number N of microphones is two, three, four, five or more. The set of microphones may comprise a third microphone for provision of a third microphone input signal.

The hearing device optionally comprises a pre-processing unit. The pre-processing unit may be connected to the radio transceiver for pre-processing the transceiver input signal. The pre-processing unit may be connected to the first microphone for pre-processing the first microphone input signal. The pre-processing unit may be connected to the second microphone if present for pre-processing the second microphone input signal. The pre-processing unit may comprise one or more ND-converters for converting analog microphone input signal(s) to digital pre-processed microphone input signal(s).

The hearing device comprises a processor for processing input signals, such as pre-processed transceiver input signal(s) and/or pre-processed microphone input signal(s). The processor is optionally configured to compensate for hearing loss of a user of the hearing device. The processor provides an electrical output signal based on the input signals to the processor. The hearing device comprises a receiver or speaker. The electrical output signal is fed to the receiver for outputting an audio output signal based on the electrical output signal. Input terminal(s) of the processor are optionally connected to respective output terminals of the pre-processing unit. For example, a transceiver input terminal of the processor may be connected to a transceiver output terminal of the pre-processing unit. One or more microphone input terminals of the processor may be connected to respective one or more microphone output terminals of the pre-processing unit.

In one or more exemplary earpieces, the first outer surface may be configured to contact the wall of the ear canal of the user when the earpiece is inserted into the ear canal of the user. Providing at least a first outer surface which may contact the ear canal wall contributes to the total area in contact between the earpiece and the ear canal wall, thereby providing an increased stability of the earpiece in the ear canal of the user.

For example, the first outer surface may comprise a flat surface or a surface with a contour similar to, or at least approximately similar to, the contour of the ear canal wall at the location where the first outer surface may be configured to contact the ear canal wall of the user.

In one or more exemplary earpieces, the second outer surface may be configured to contact the wall of the ear canal of the user when the earpiece is inserted into the ear canal of the user. Providing at least a second outer surface which may contact the wall of the ear canal contributes to the total area in contact between the earpiece and the ear canal wall, thereby providing an increased stability of the earpiece in the ear canal of the user. For example, the second outer surface may comprise a flat surface or a surface with a contour similar to, or at least approximately similar to, the contour of the ear canal wall at the location where the second outer surface may be configured to contact the ear canal wall of the user.

In one or more exemplary earpieces, the first channel part may have a first diameter in a range of 0.5 mm to 5 mm. Thereby, occlusion is successfully prevented, while still ensuring a structural integrity/stiffness of the first protrusion sufficient to provide a stable mounting/accommodation of the earpiece in the ear canal. The first channel part may have a first diameter in a range of 1 mm to 3 mm. For example, the first channel part may have a first diameter of at least 1.0 mm, such as 1.5 mm, 2.0 mm, 2.5 mm, 3.0 mm, 3.5 mm, 4.0 mm, or 4.5 mm. The first diameter and/or the cross-sectional area of the first channel part may be constant along the length of the first channel part. The first diameter may vary along the length of the first channel part. Accordingly, the first diameter and/or cross-sectional area may be larger at the ends of the first channel part than between the ends. In one or more exemplary hearing devices, the first diameter is less than 3.5 mm, e.g. in order to reduce audio feedback.

In one or more exemplary earpieces, the second channel part may have a second diameter in a range of 0.5 mm to 5 mm. Thereby, occlusion is successfully prevented, while still ensuring a structural integrity/stiffness of the second protrusion sufficient to provide a stable mounting/accommodation of the earpiece in the ear canal. The second channel part may have a second diameter in a range of 1 mm to 3 mm. For example, the second channel part may have a second diameter of at least 1.0 mm, such as 1.5 mm, 2.0 mm, 2.5 mm, 3.0 mm, 3.5 mm, 4.0 mm, or 4.5 mm. The second diameter and/or the cross-sectional area of the second channel part may be constant along the length of the second channel part. The second diameter may vary along the length of the second channel part. Accordingly, the second diameter and/or cross-sectional area may be larger at the ends of the second channel part than between the ends. In one or more exemplary hearing devices, the second diameter is less than 3.5 mm, e.g. in order to reduce audio feedback.

In one or more exemplary earpieces, a cross-sectional area of the intermediate cavity is larger than a cross-sectional area of the first channel part and/or larger than a cross-sectional area of the second channel part.

In one or more exemplary earpieces, the second diameter may be smaller than or larger than the first diameter. The first channel part provides fluid communication between the ear canal cavity and the intermediate cavity, for which reason the first diameter preferably should be minimized to ensure that a sufficiently high sound pressure can be created in the ear canal cavity.

In one or more exemplary earpieces, the first channel part may have a first length (also denoted L_2) in a range of 1 to 12 mm, e.g. in a range of 1 mm to 5 mm and/or in a range from 6 mm to 12 mm. The first length may be in a range from 2.0 mm to 3.5 mm, such as from 2.5 mm to 3.0 mm, e.g. to obtain a first protrusion with a sufficient mechanical strength while providing satisfactory occlusion reducing properties. For example, the first length may be at least 1 mm, such as 2 mm, 3 mm, 4 mm, or 5 mm. The first channel part may form part of the vent of the earpiece of the hearing device. Therefore, reducing the first length of the first channel part may result in a reduction of the total length of the vent and, thereby, a reduction of the occlusion.

In one or more exemplary earpieces, the second channel part may have a second length (also denoted L_4) in a range of 1 to 12 mm, e.g. in a range of 1 mm to 5 mm and/or in a range from 6 mm to 12 mm. Exemplary second lengths are 3 mm, 4 mm, 5 mm, 6 mm, 7 mm, 8 mm, 9 mm, or 10 mm. For example, the second length may be at least 1 mm, such as 2 mm, 3 mm, 4 mm, or 5 mm. The second channel part may form part of the vent of the earpiece of the hearing device. Therefore, reducing the second length of the second channel part results in a reduction of the total length of the vent and, thereby, a reduction of the occlusion. A relatively short second channel part may be preferred due to occlusion properties, while a relatively long second channel part may be preferred due to a desire of increased stable in fitting.

In one or more exemplary earpieces, the intermediate cavity may have a length (also denoted L_3) in a range of 1 mm to 15 mm, such as in a range from 3 mm to 12 mm. Exemplary lengths of the intermediate cavity are about 4 mm, about 5 mm, about 6 mm, about 7 mm, about 8 mm, about 9 mm, about 10 mm, or about 11 mm. For example, the length of the intermediate cavity may be at least 2 mm, such as 3 mm, 4 mm, 5 mm, 6 mm, 7 mm, 8 mm, 9 mm, 10 mm, or 11 mm. Increasing the length of the intermediate cavity has the effect that the first length of the first channel part and/or the second length of the second channel part may be decreased or the first and second protrusion may be moved away from each other, which in turn results in a reduction in the length of the vent and/or channel parts and, thereby, the occlusion properties can be optimized. The intermediate cavity may be open. In other words, the intermediate cavity may be configured to not touch (or be defined by) the ear canal wall of the user, which results in less pressure being exerted on the ear canal wall and a more comfortable fitting/mounting of the earpiece of the hearing device in ear canal of the user. Thus, an increase in the length of the intermediate cavity, may lead to a decrease of surface area in contact between the earpiece and the ear canal wall.

In one or more exemplary earpieces, the length of the intermediate cavity may be larger than the first length of the first channel part. For example, the length of the intermediate cavity may be 11.25 mm, 9.75 mm, 7.75 mm, 5.5 mm, or 3.5 mm, and/or the first length may be at least 1.0 mm, such as 2.0 mm, 3.0 mm, 4.0 mm, or 5.0 mm. Thereby, the surface area in contact between the earpiece and the ear canal wall is reduced, which results in a more comfortable and stable fitting/mounting of the earpiece in ear canal of the user, optionally while having satisfactory occlusion properties.

In one or more exemplary earpieces, the length of the intermediate cavity may be larger than the second length. For example, the length of the intermediate cavity may be 11.25 mm, 9.75 mm, 7.75 mm, 5.5 mm, or 3.5 mm, and the second length may be 1 mm, 3 mm, or 5 mm. Thereby, the surface area in contact between the earpiece and the ear canal wall is reduced, which results in a more comfortable fitting/mounting of the earpiece in ear canal of the user.

In one or more exemplary earpieces, the length of the intermediate cavity may be larger than the sum of the first length and the second length. For example, the intermediate cavity may be 6 mm, the first length may be 2 mm, and the second length may be 2 mm.

In one or more exemplary earpieces, the first channel part may have a first primary opening directed towards the ear canal cavity. Directed towards may refer to the first primary opening being configured to open/end in the ear canal cavity even though the first primary opening is angled relative to the ear canal axis. In other words, the first primary opening may open/end in the ear canal cavity. In one or more exemplary earpieces, the first primary opening may comprise rounded edges. Alternatively, the first primary opening may comprise tapered, or angled (e.g. 90, 45, or 30 degrees) edges.

In one or more exemplary earpieces, the first channel part may have a first secondary opening directed towards the intermediate cavity. In other words, the first secondary opening may open/end in the intermediate cavity. In one or more exemplary earpieces, the first secondary opening may comprise rounded edges. Alternatively, the first secondary opening may comprise tapered, or angled (e.g. 90, 45, or 30 degrees) edges.

In one or more exemplary earpieces, the second channel part may have a second primary opening directed towards the surroundings of the user. In other words, the second primary opening may open/end in the surroundings of the user. In one or more exemplary earpieces, the second primary opening may comprise rounded edges. Applying rounded edges reduces the noise (e.g. howling) created by sound waves entering the ear canal cavity via the first channel part and the second channel part. Alternatively, the second primary opening may comprise tapered, or angled (e.g. 90, 45, or 30 degrees) edges.

In one or more exemplary earpieces, the second channel part may have a second secondary opening directed towards the intermediate cavity. In other words, the second secondary opening may open/end in the intermediate cavity. In one or more exemplary earpieces, the second secondary opening may comprise rounded edges. Alternatively, the second secondary opening may comprise tapered, or angled (e.g. 90, 45, or 30 degrees) edges.

In one or more exemplary earpieces, the intermediate cavity may be formed at least partly by an outer surface of the earpiece housing. In other words, the intermediate cavity may be open so that the intermediate cavity does not touch the ear canal wall, when the earpiece has been inserted in the ear of the user. Thereby, a reduction in the surface area of the earpiece in contact with the ear canal wall is achieved leading to a more comfortable fitting/mounting of the earpiece of the hearing device in ear canal of the user.

In one or more exemplary earpieces, the first protrusion may form an integrated part of the ear canal part. In one or more exemplary earpieces, the second protrusion may form an integrated part of the ear canal part. In other words, the first protrusion and/or the second protrusion, and the ear canal part may be produced as one unit, thereby simplifying production of the earpiece.

In one or more exemplary earpieces, the first protrusion (e.g. the first primary opening) may be arranged at a first distance from the first end. The first distance may be in a range from 0.5 mm to 4.0 mm. For example, the first distance may be 0.5 mm or at least 1.0 mm. Exemplary first distances are 1.0 mm, 1.5 mm, 2.0 mm, 2.3 mm, 2.5 mm, or 3.0 mm. In other words, the first protrusion may be arranged between the first end and the intermediate cavity relative to the ear canal axis of the earpiece. Accordingly, the first primary opening of the the first channel part may be arranged a first distance from the first end. Thereby, the total length of the vent may be reduced and an arrangement of a sound opening in the first end close to the tympanic membrane is provided.

In one or more exemplary earpieces, the sum of the first distance, the first length, and the length of the intermediate cavity is larger than 8 mm, such as in the range from 10 mm to 20 mm. In other words, the distance from the second secondary opening to the first end may be larger than 8 mm, such as in the range from 10 mm to 20 mm.

A method of manufacturing an earpiece of a hearing device is disclosed. The method comprises obtaining a model of the ear canal of the user. For example, obtaining a model of the ear canal of the user may comprise creating a physical model of the ear canal by inserting a deformable material into the ear canal. Alternatively, or in addition, obtaining a model of the ear canal of the user may comprise creating a digital model of the ear canal by scanning the ear canal of the user. The method comprises designing an earpiece housing member based on the model of the ear canal. The outer surface of the earpiece housing member may fit the ear canal wall of the user. In one or more exemplary methods, designing an earpiece housing member may comprise analysing the model of the ear canal. In one or more exemplary methods, designing an earpiece housing member may comprise providing a model of an earpiece configured to fit the ear canal wall of the user, e.g. by use of a 3D simulation software. The method comprises removing a part of the earpiece housing member to form a first protrusion. Thereby, the surface area in contact between the earpiece housing member and the ear canal wall is reduced, while maintaining stability in the fitting/mounting of the earpiece housing member in ear canal of the user. The method comprises removing a part of the earpiece housing member to form a second protrusion. Thereby, the surface area in contact between the earpiece housing member and the ear canal wall is lowered, while maintaining stability in the fitting/mounting of the earpiece housing member in ear canal of the user. The method comprises removing a part of the earpiece housing member to form an intermediate cavity in the earpiece housing member. Thereby, occlusion of the ear of the user is reduced as the length of the first channel part and of the second channel part (i.e. of the vent) is reduced. The method comprises moulding the earpiece housing member. In one or more exemplary methods, moulding the earpiece housing member may comprise printing an earpiece housing member, or printing a model of an earpiece housing member, e.g. by a 3D printing device.

In one or more exemplary methods, the method may comprise forming a first channel part in the first protrusion. In one or more exemplary methods, forming a first channel part in the first protrusion may comprise forming the first channel part prior to moulding the earpiece housing member, e.g. by use of a 3D simulation software. In one or more exemplary methods, forming a first channel part in the first protrusion may comprise forming the first channel part in response to moulding the earpiece housing member, e.g. by use of mechanical drilling, etching, heat treatment, etc. In one or more exemplary methods, the method may comprise forming a second channel part in the second protrusion. In one or more exemplary methods, forming a second channel part in the second protrusion may comprise forming the second channel part prior to moulding the earpiece housing member, e.g. by use of a 3D simulation software. In one or more exemplary methods, forming a second channel part in the second protrusion may comprise forming the second channel part in response to moulding the earpiece housing member, e.g. by use of mechanical drilling, etching, heat treatment, etc.

FIG. 1 illustrates an exemplary earpiece 1 of a hearing device. The earpiece 1 comprises an earpiece housing 2. The earpiece housing 2 comprises an ear canal part 3 to be introduced into the ear canal of a user. The earpiece 1 is configured to form an ear canal cavity between the tympanic membrane of the ear canal and the earpiece housing 2, when inserted into the ear canal of the user. The ear canal part 3 extends along an ear canal axis X of the earpiece 1. Therefore, inserting the earpiece 1 into the ear canal of a user may comprise moving the earpiece in a direction parallel with the ear canal axis X. The earpiece housing 2 comprises an outer surface 5 at least partly customised, corresponding or adapted to the ear canal surface of a user.

The ear canal part 3 has a first end 4. The first end 4 may be configured to be positioned in the ear canal of the user, after the earpiece 1 has been inserted in the ear canal. The ear canal part 3 may further have a second end 6 arranged opposite the first end 4 relative to the ear canal axis X. The second end 6 of the ear canal part 3 may be configured to be facing the surroundings of the user, after the earpiece 1 has been inserted in the ear canal. The second end 6 may be positioned inside or outside the ear canal of the user, when the earpiece 1 is arranged in the ear canal, depending on type of hearing device.

The earpiece housing 2 comprises a first protrusion 7 with a first outer surface 8. The first outer surface may form a part of the outer surface 5 of the earpiece housing 2. The first protrusion may protrude in a direction orthogonal to the ear canal axis X.

The earpiece housing 2 comprises a second protrusion 9 with a second outer surface 10. The second outer surface 10 may form a part of the outer surface 5 of the earpiece housing 2. The second protrusion 9 may protrude in a direction orthogonal to the ear canal axis X.

The earpiece housing 2 comprises an intermediate cavity 11 arranged between the first protrusion 7 and the second protrusion 9. In FIG. 1, it is illustrated that the intermediate cavity 11 may be formed at least partly by the outer surface 5 of the earpiece housing 2. Therefore, the outer surface 5 of the earpiece housing 2 may form the inner surface of the intermediate cavity 11.

The first protrusion 7 is arranged between the first end 4 of the ear canal part 3 and the second protrusion 9 relative to the ear canal axis X. The first protrusion 7 comprises a first channel part 12 providing fluid communication between the ear canal cavity and the intermediate cavity 11. The first channel part 12 may have a first primary opening 13 directed towards the first end 4 and towards the ear canal cavity. The first channel part 12 may have a first secondary opening directed towards the intermediate cavity 11.

The second protrusion 9 may be arranged between the second end 6 of the ear canal part 3 and the intermediate cavity 11 relative to the ear canal axis X. The second protrusion 9 comprises a second channel part 14 providing fluid communication between the intermediate cavity 11 and surroundings of the user. The second channel part 14 may have a second primary opening directed towards the surroundings of the user. The second channel part 14 has a second secondary opening 15 directed towards the intermediate cavity 11.

The earpiece housing 2 may comprise a first end cavity 16 arranged between the first protrusion 7 and the first end 4 of the ear canal part 3 (and of the earpiece housing 2). The earpiece housing 2 may further comprise a second end cavity 17 arranged between the second protrusion 9 and the second end 6 of the ear canal part 3 (and of the earpiece housing 2). The intermediate cavity 11 and/or the first end cavity 16 and/or the second end cavity 17 may be formed by removing a part of an earpiece housing 2 formed to fit the contour of the ear canal wall.

The first end 4 of the ear canal part 3 may comprise a first end opening 4' comprising a loudspeaker of the earpiece 1 and of the hearing device. The loudspeaker may be configured to direct sound waves in a direction towards the tympanic membrane, when the earpiece 1 is arranged in the ear canal of the user.

In FIG. 1, an indication of the length L_1 of the first end cavity 16, the length L_2 (first length) of the first protrusion 7, the length L_3 of the intermediate cavity 11, the length L_4 (second length) of the second protrusion 9, and the length L_5 of the second end cavity 17 relative to the ear canal axis X is given. The length L_2 of the first protrusion 7, the length L_3 of the intermediate cavity 11, and the length L_4 of the second protrusion 9 indicate of the length of the vent of the earpiece 1. Minimising the length of the vent leads to a reduction of the occlusion.

For example, when designing the earpiece 1, the length L_3 of the intermediate cavity 11 may be estimated by assuming that:

- the sum of the lengths L_1, L_2, L_3 of the first end cavity 16, the first protrusion 7, and the intermediate cavity 11 may be set depending on the length of the ear canal of the user, e.g. it may be set to at least 8 mm, e.g. 10 mm;
- the length L_2 of the first protrusion 7 may be set to e.g. 3 mm;
- the length L_1 of first end cavity 16 may be set to e.g. 15% of the sum of the lengths L_1, L_2, L_3.

Therefore, the length L_3 of the intermediate cavity 11 may be estimated to:

$$\begin{aligned} L_3 &= (L_1 + L_2 + L_3) - (15\% \text{ of } (L_1 + L_2 + L_3)) - L_2 \\ &= 10 \text{ mm} - 1.5 \text{ mm} - 3 \text{ mm} \\ &= 5.5 \text{ mm} \end{aligned}$$

Figure 2:
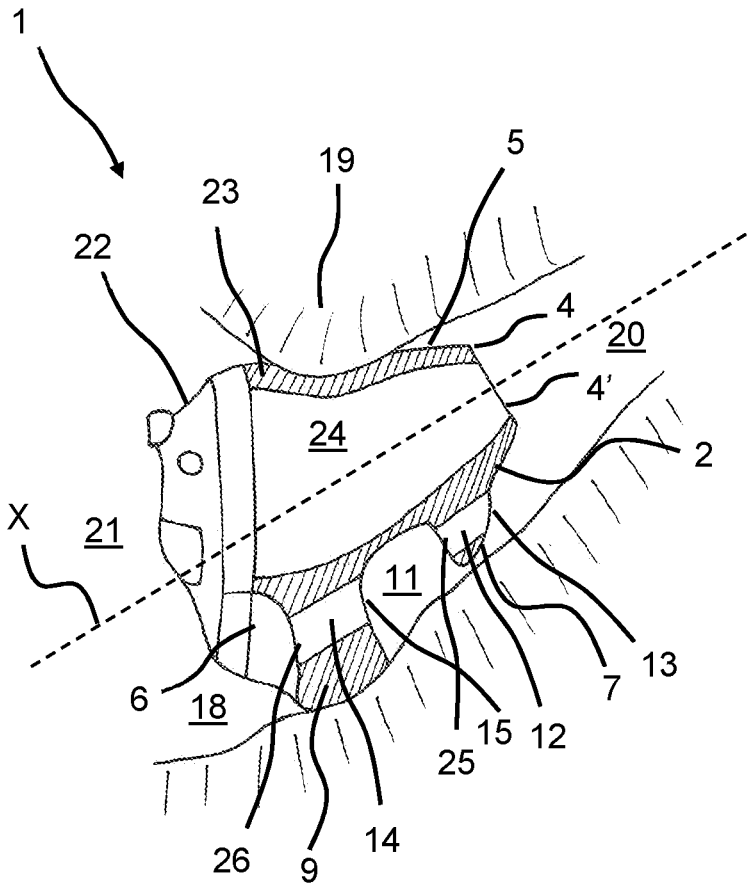
FIG. 2 illustrates a cross section of an exemplary earpiece of a hearing device.

FIG. 2 illustrates a cross section of an exemplary earpiece of a hearing device. In FIG. 2, the earpiece 1 has been inserted in the ear canal 18 of a user, where the ear canal 18 comprises an ear canal wall 19. At least part of the outer surface 5 of the earpiece housing 2 may contact the ear canal wall 19. In FIG. 2, the first protrusion 7 does not touch the ear canal wall 19, whereas the second protrusion 9 touch the ear canal wall 19. The first end 4 of the earpiece housing 2 may be directed towards the tympanic membrane so that the earpiece 1 is configured to form an ear canal cavity 20 between the tympanic membrane and the earpiece housing 2 when inserted into the ear canal 18 of the user. The second end 6 of the earpiece housing 2 may be directed towards the surroundings 21 of the user. A faceplate 22 may be connected to the second end 6 of the earpiece housing 2.

The earpiece housing 2 may comprise an outer wall 23 enclosing an inner volume 24 of the earpiece housing 2. The inner volume 24 may be configured to contain e.g. one or more of a receiver, processor, battery, microphones, wiring, etc. of the hearing device. As illustrated in FIG. 2, the earpiece housing 2 (and/or the inner volume 24) may have the largest diameter and/or cross-sectional area at the second end 6 and the smallest diameter/cross-sectional area at the first end 4. The first channel part 12 may have a first primary opening 13 directed towards the ear canal cavity 20. The first channel part 12 may have a first secondary opening 25 directed towards the intermediate cavity 11. The second channel part 14 may have a second primary opening 26 directed towards the surroundings 21 of the user. The second channel part 14 has a second secondary opening 15 directed towards the intermediate cavity 11. Thereby, fluid communication may be provided between the ear canal cavity 20 and the surroundings 21 of the user, via the intermediate cavity 11, and the second channel part 14, and optionally the first channel part 12.

Figure 3:
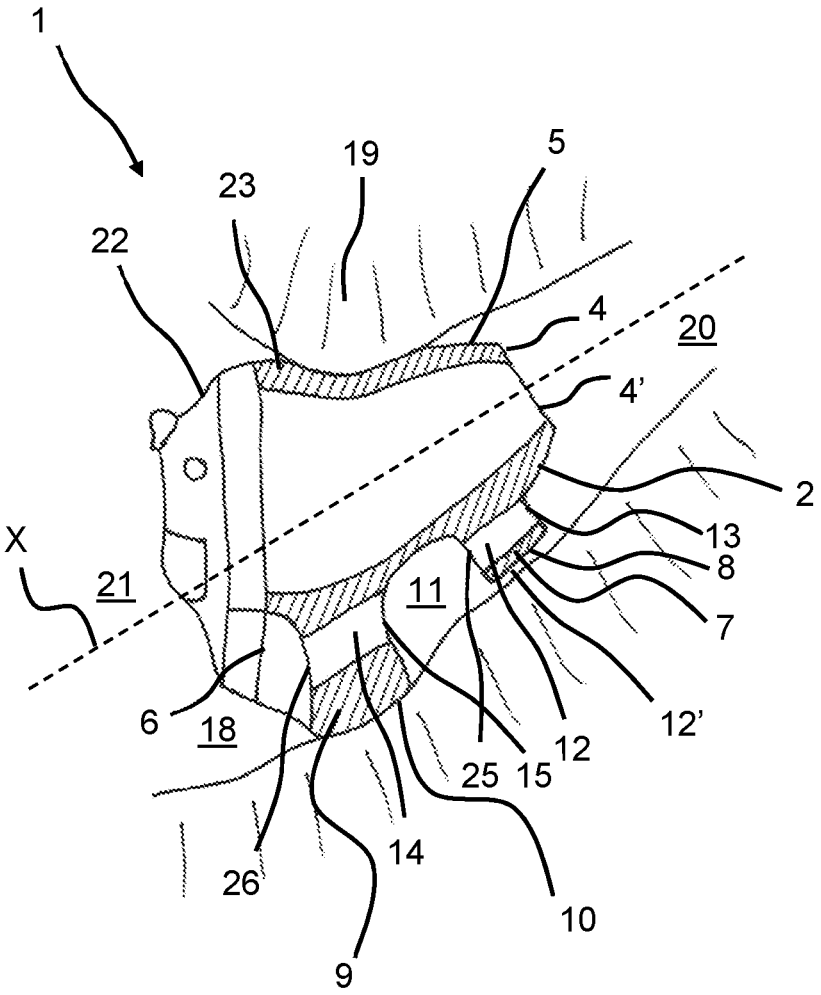
FIG. 3 illustrates a cross section of an exemplary earpiece of a hearing device.

FIG. 3 illustrates a cross section of an exemplary earpiece 1 of a hearing device. The first outer surface 8 of the first protrusion 7 is not contacting the ear canal wall 19. As the first protrusion 7 does not touch the ear canal wall 19, sound waves/acoustic pressure will escape the ear canal cavity 20, via the first channel part 12, the intermediate cavity 11 and the second channel part 14, or optionally, only via the intermediate cavity 11 and the second channel part 14 thereby bypassing the first channel part 12 via the space 12' between the first channel part 12 and the ear canal wall 19. The factor determining whether the first channel part 12 or the space 12' is used is the earlier mentioned acoustic mass or acoustic impedance. In other words, if the acoustic mass or acoustic impedance is lower for the first channel part 12 than for the space 12' the first channel part 12 will be the preferred route for sound waves/acoustic pressure escaping the ear canal cavity 20. In FIG. 3, the first outer surface 8 of the first protrusion 7 comprises an outer surface facing the ear canal wall 19 and having a contour substantially consistent with the ear canal wall 19.

Figure 4:
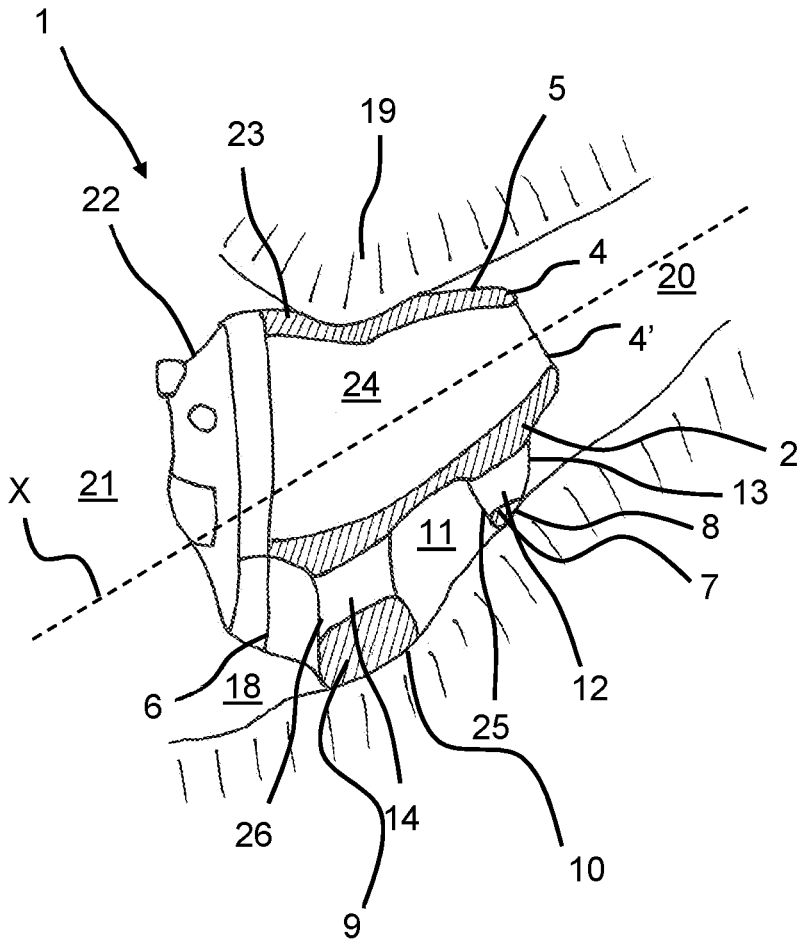
FIG. 4 illustrates a cross section of an exemplary earpiece of a hearing device.

FIG. 4 illustrates a cross section of an exemplary earpiece 1 of a hearing device. In FIG. 4, the first outer surface 8 of the first protrusion 7 is contacting the ear canal wall 19. By both the first protrusion 7 and the second protrusion 9 contacting/touching the ear canal wall 19, the stability of the earpiece 1 in the ear canal 18 is improved compared to if only one protrusion is contacting the ear canal wall 19. Thereby, fluid communication may be provided between the ear canal cavity 20 and the surroundings 21 of the user, via the first channel part 12, the intermediate cavity 11, and the second channel part 14.

Figure 5:
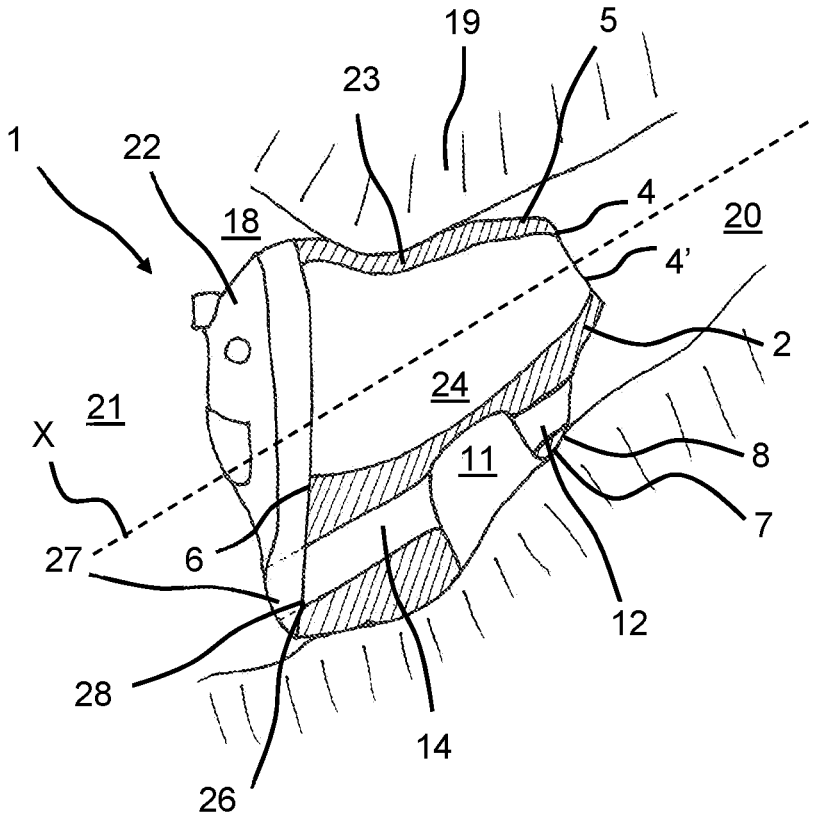
FIG. 5 illustrates a cross section of an exemplary earpiece of a hearing device.

FIG. 5 illustrates a cross section of an exemplary earpiece 1 of a hearing device. In FIG. 5, the first outer surface 8 of the first protrusion 7 is contacting the ear canal wall 19. Further, the second channel part 14 may be in direct contact with the faceplate 22. The faceplate 22 may comprise a faceplate channel part 27. The second primary opening 26 of the second channel part 14 may be positioned at a first primary opening 28 of the faceplate channel part 27. Thereby, fluid communication may be provided between the ear canal cavity 20 and the surroundings 21 of the user, via the first channel part 12, the intermediate cavity 11, the second channel part 14, and the faceplate channel part 27.

Figure 6:
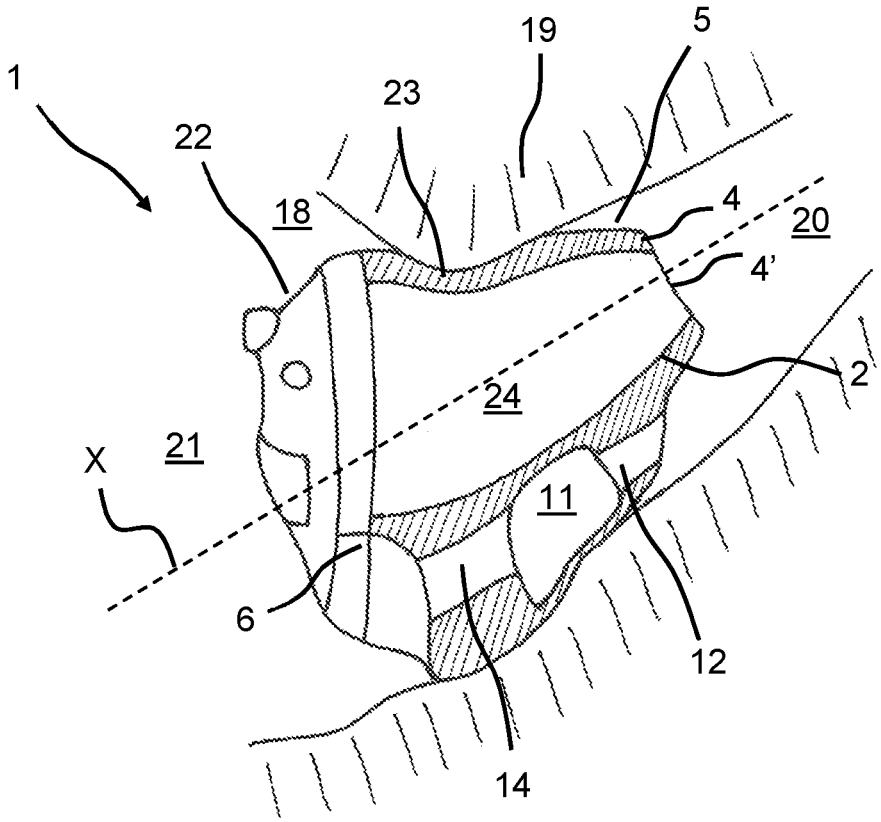
FIG. 6 illustrates a cross section of an exemplary earpiece of a hearing device.

FIG. 6 illustrates a cross section of an exemplary earpiece 1 of a hearing device. In FIG. 6, the outer surface 5 of the earpiece housing 2 may enclose the intermediate cavity 11. Thereby, the intermediate cavity 11 may form an inner opening/cavity/volume of the earpiece housing 2. The part of the outer surface 5 of the earpiece housing 2, which encloses the intermediate cavity 11, may touch/contact the ear canal wall 19 facilitating the stability of the earpiece 1 in the ear canal 18. The part of the outer surface 5 of the earpiece housing 2, which encloses the intermediate cavity 11, may not touch/contact the ear canal wall 19 facilitating a less bulky feeling of the earpiece 1 in the ear canal 18.

Figure 7:
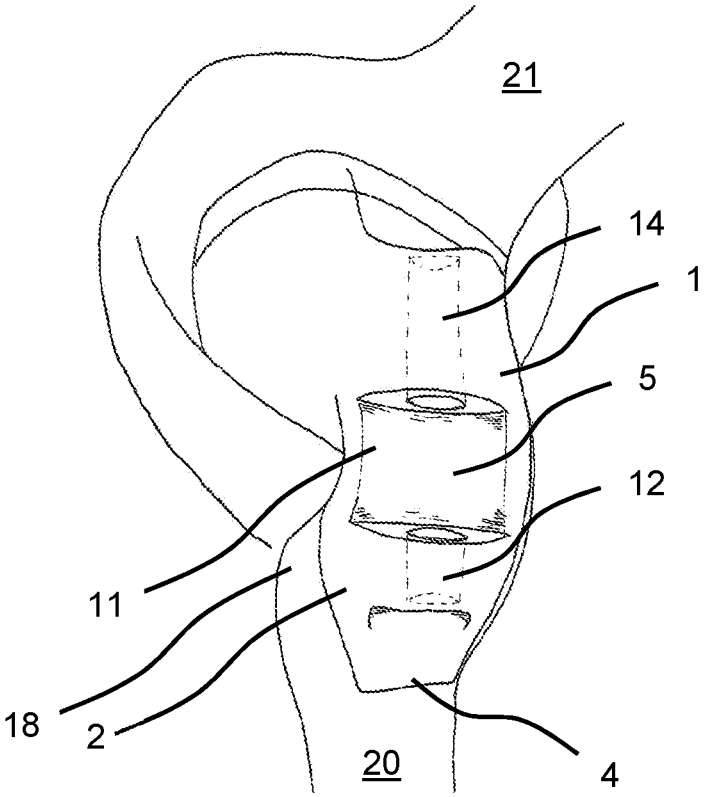
FIG. 7 illustrates an exemplary earpiece of a hearing device arranged in the ear canal of a user.

FIG. 7 illustrates an exemplary earpiece 1 of a hearing device arranged in the ear canal 18 of a user. In FIG. 7, the intermediate cavity 11 may be formed by the outer surface 5 of the earpiece housing 2. Thereby, fluid communication may be provided between the ear canal cavity 20 and the surroundings 21 of the user, via the first channel part 12, the intermediate cavity 11, and the second channel part 14.

Embodiments of earpieces and related methods according to the disclosure are set out in the following items:

Item 1. Earpiece for a hearing device, the earpiece comprising an earpiece housing comprising:

- an ear canal part to be introduced into the ear canal of a user, the earpiece configured to form an ear canal cavity between the tympanic membrane of the ear canal and the earpiece housing when inserted into the ear canal of the user, where the ear canal part extends along an ear canal axis of the earpiece, the ear canal part having a first end configured to be positioned in the ear canal of the user;

a first protrusion with a first outer surface;

a second protrusion with a second outer surface; and an intermediate cavity arranged between the first protrusion and the second protrusion, wherein the first protrusion is arranged between the first end of the ear canal part and the second protrusion along the ear canal axis, the first protrusion comprising a first channel part providing fluid communication between the ear canal cavity and the intermediate cavity, and the second protrusion comprising a second channel part providing fluid communication between the intermediate cavity and surroundings of the user.

Item 2. Earpiece according to item 1, wherein the first outer surface is configured to contact the wall of the ear canal of the user when the earpiece is inserted into the ear canal of the user.

Item 3. Earpiece according to any of items 1-2, wherein the second outer surface is configured to contact the wall of the ear canal of the user when the earpiece is inserted into the ear canal of the user.

Item 4. Earpiece according to any of items 1-3, wherein the first channel part has a first diameter in a range of 0.5 mm to 5 mm.

Item 5. Earpiece according to any of items 1-4, wherein the second channel part has a second diameter in a range of 0.5 mm to 5 mm.

Item 6. Earpiece according to item 5 as dependent on item 4, wherein the second diameter is larger than the first diameter.

Item 7. Earpiece according to any of items 1-6, wherein the first channel part has a first length in a range of 1 mm to 5 mm.

Item 8. Earpiece according to any of items 1-7, wherein the second channel part has a second length in a range of 1 mm to 12 mm, such as in a range from 1 mm to 5 mm.

Item 9. Earpiece according to any of items 1-8, wherein the intermediate cavity has a length in a range of 3 mm to 10 mm.

Item 10. Earpiece according to item 9, wherein the length of the intermediate cavity is larger than the first length.

Item 11. Earpiece according to any of items 9-10, wherein the length of the intermediate cavity is larger than the second length.

Item 12. Earpiece according to any of items 9-11, wherein the length of the intermediate cavity is larger than the sum of the first length and the second length.

Item 13. Earpiece according to any of items 1-12, wherein the first channel part has a first primary opening directed towards the ear canal cavity, the first primary opening comprising rounded edges.

Item 14. Earpiece according to any of items 1-13, wherein the first channel part has a first secondary opening directed towards the intermediate cavity, the first secondary opening comprising rounded edges.

Item 15. Earpiece according to any of items 1-14, wherein the second channel part has a second primary opening directed towards the surroundings of the user, the second primary opening comprising rounded edges.

Item 16. Earpiece according to any of items 1-15, wherein the second channel part has a second secondary opening directed towards the intermediate cavity, the second secondary opening comprising rounded edges.

Item 17. Earpiece according to any of items 1-16, wherein the intermediate cavity is formed at least partly by an outer surface of the earpiece housing.

Item 18. Earpiece according to any of items 1-17, wherein the first protrusion and the second protrusion form an integrated part of the ear canal part.

Item 19. Earpiece according to any of items 1-18, wherein the first protrusion is arranged at a first distance from the first end, wherein the first distance is in a range from 0.5 mm to 4.0 mm, such as in a range from 2.0 mm to 3.5 mm, e.g. in a range from 2.5 mm to 3.0 mm.

Item 20. Method of manufacturing an earpiece of a hearing device, the method comprising:

obtaining a model of the ear canal of the user;

designing an earpiece housing member based on the model of the ear canal;

removing a part of the earpiece housing member to form a first protrusion, a second protrusion, and an intermediate cavity in the earpiece housing member;

moulding the earpiece housing member.

Item 21. Method according to item 20, the method comprising forming a first channel part in the first protrusion, and forming a second channel part in the second protrusion.

The use of the terms "first", "second", "third" and "fourth", "primary", "secondary", "tertiary" etc. does not imply any particular order, but are included to identify individual elements. Moreover, the use of the terms "first", "second", "third" and "fourth", "primary", "secondary", "tertiary" etc. does not denote any order or importance, but rather the terms "first", "second", "third" and "fourth", "primary", "secondary", "tertiary" etc. are used to distinguish one element from another. Note that the words "first", "second", "third" and "fourth", "primary", "secondary", "tertiary" etc. are used here and elsewhere for labelling purposes only and are not intended to denote any specific spatial or temporal ordering.

Furthermore, the labelling of a first element does not imply the presence of a second element and vice versa.

It is to be noted that the word "comprising" does not necessarily exclude the presence of other elements or steps than those listed.

It is to be noted that the words "a" or "an" preceding an element do not exclude the presence of a plurality of such elements.

It should further be noted that any reference signs do not limit the scope of the claims, that the exemplary embodiments may be implemented at least in part by means of both hardware and software, and that several "means", "units" or "devices" may be represented by the same item of hardware.

The various exemplary methods, devices, and systems described herein are described in the general context of method steps processes, which may be partly or fully implemented in one aspect by a computer program product, embodied in a computer-readable medium, including computer-executable instructions, such as program code, executed by computers in networked environments. A computer-readable medium may include removable and non-removable storage devices including, but not limited to, Read Only Memory (ROM), Random Access Memory (RAM), compact discs (CDs), digital versatile discs (DVD), etc. Generally, program modules may include routines, programs, objects, components, data structures, etc. that perform specified tasks or implement specific abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps or processes.

Although features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications, and equivalents.

LIST OF REFERENCES

1 Earpiece
2 earpiece housing
3 ear canal part
4 first end
4' first end opening
5 outer surface
6 second end
7 first protrusion
8 first outer surface
9 second protrusion
10 second outer surface
11 intermediate cavity
12 first channel part
12' space
13 first primary opening
14 second channel part
15 second secondary opening
16 first end cavity
17 second end cavity
18 ear canal
19 ear canal wall
20 ear canal cavity
21 surroundings
22 faceplate
23 outer wall
24 inner volume
25 first secondary opening
26 second primary opening
27 faceplate channel part
28 first primary opening

The invention claimed is:

1. An earpiece for a hearing device, the earpiece comprising an earpiece housing comprising:

an ear canal part to be introduced into an ear canal of a user, wherein the ear canal part extends along an ear canal axis of the earpiece, the ear canal part having a first end configured to be positioned in the ear canal of the user;

a first protrusion with a first outer surface; and a second protrusion with a second outer surface; and an intermediate space between the first protrusion and the second protrusion;

wherein the first protrusion is between the first end of the ear canal part and the second protrusion along the ear canal axis, the first protrusion comprising a first channel part configured to provide fluid communication between an ear canal cavity and the intermediate space, the second protrusion comprising a second channel part configured to provide fluid communication between the intermediate space and a surrounding of the user; and wherein the earpiece housing comprises a housing wall defining at least a part of a cavity, the cavity configured to house an electronic component, and wherein the housing wall is integral with the first protrusion and with the second protrusion.

2. The earpiece according to claim 1, wherein the first outer surface is configured to contact a wall of the ear canal of the user when the earpiece is inserted into the ear canal of the user.

3. The earpiece according to claim 1, wherein the second outer surface is configured to contact a wall of the ear canal of the user when the earpiece is inserted into the ear canal of the user.

4. The earpiece according to claim 1, wherein the first channel part has a first length in a range of 1 mm to 5 mm.

5. The earpiece according to claim 1, wherein the second channel part has a second length in a range of 1 mm to 5 mm.

6. The earpiece according to claim 1, wherein the intermediate space has a length in a range of 3 mm to 10 mm.

7. The earpiece according to claim 1, wherein the first channel part has a first primary opening directed towards the ear canal cavity, the first primary opening comprising a first rounded edge, and the second channel part has a second secondary opening directed towards the intermediate space, the second secondary opening comprising a second rounded edge.

8. The earpiece according to claim 1, wherein the intermediate space is at least partially defined by an outer surface of the earpiece housing.

9. The earpiece according to claim 1, wherein the first protrusion is at a first distance from the first end, wherein the first distance is in a range from 0.5 mm to 4.0 mm.

10. The earpiece according to claim 1, wherein the ear canal cavity is between a tympanic membrane and the earpiece housing when the earpiece is inserted into the ear canal of the user.

11. The earpiece according to claim 1, wherein at least a section of the first channel is completely surrounded by a material of the earpiece housing.

12. The earpiece according to claim 1, wherein at least a section of the second channel is completely surrounded by a material of the earpiece housing.

13. The earpiece according to claim 1, wherein the housing wall comprises a side wall extending along the ear canal axis, and wherein the first protrusion and/or the second protrusion extends from the side wall.

14. The earpiece according to claim 1, wherein the earpiece housing having the first and second protrusions is at least partly customized.

15. The earpiece according to claim 1, wherein the first protrusion is located at a longitudinal side of the earpiece housing.

16. The earpiece according to claim 1, wherein the second protrusion is located at a longitudinal side of the earpiece housing.

17. The earpiece according to claim 1, wherein when the earpiece is being worn by the user, the first protrusion is located between a wall of the ear canal and an electrical component of the earpiece.

18. The earpiece according to claim 1, wherein when the earpiece is being worn by the user, the second protrusion is located between a wall of the ear canal and an electrical component of the earpiece.

19. An earpiece for a hearing device, the earpiece comprising an earpiece housing comprising:

an ear canal part to be introduced into an ear canal of a user, wherein the ear canal part extends along an ear canal axis of the earpiece, the ear canal part having a first end configured to be positioned in the ear canal of the user;

a first protrusion with a first outer surface; and a second protrusion with a second outer surface; and an intermediate space between the first protrusion and the second protrusion;

wherein the first protrusion is between the first end of the ear canal part and the second protrusion along the ear canal axis, the first protrusion comprising a first channel part configured to provide fluid communication between an ear canal cavity and the intermediate space, the second protrusion comprising a second channel part configured to provide fluid communication between the intermediate space and a surrounding of the user;

wherein the first channel part has a first diameter in a range of 0.5 mm to 5 mm, and the second channel part has a second diameter in a range of 0.5 mm to 5 mm, and wherein the second diameter is larger than the first diameter.

20. An earpiece for a hearing device, the earpiece comprising an earpiece housing comprising:

an ear canal part to be introduced into an ear canal of a user, wherein the ear canal part extends along an ear canal axis of the earpiece, the ear canal part having a first end configured to be positioned in the ear canal of the user;

a first protrusion with a first outer surface; and a second protrusion with a second outer surface; and an intermediate space between the first protrusion and the second protrusion;

wherein the first protrusion is between the first end of the ear canal part and the second protrusion along the ear canal axis, the first protrusion comprising a first channel part configured to provide fluid communication between an ear canal cavity and the intermediate space, the second protrusion comprising a second channel part configured to provide fluid communication between the intermediate space and a surrounding of the user;

wherein a length of the intermediate space is larger than a length of the first channel part and/or a length of the second channel part.

21. The earpiece according to claim 20, wherein the length of the intermediate space is larger than a sum of the length of the first channel part and the length of the second channel part.

22. A method of manufacturing an earpiece of a hearing device, comprising:

obtaining a model of an ear canal of a user;

determining a configuration of an earpiece housing member to be formed based on the model of the ear canal, wherein the earpiece housing member to be formed comprises a first protrusion, a second protrusion, and an intermediate space between the first protrusion and the second protrusion;

forming the earpiece housing member based on the determined configuration;

forming a first channel part in the first protrusion; and forming a second channel part in the second protrusion;

wherein the formed earpiece housing member comprises a housing wall defining at least a part of a cavity, the cavity configured to house an electronic component, and wherein the acts of forming are performed such that the housing wall is integral with the first protrusion and with the second protrusion.

23. The method of claim 22, wherein the act of forming the earpiece housing member comprises molding the earpiece housing member.

24. The method of claim 22, wherein the act of determining the configuration of the earpiece housing member to be formed comprises:

determining a model for the earpiece housing member; and removing a part of the model to define a configuration of the first protrusion and a configuration of the second protrusion.

25. An earpiece for a hearing device, the earpiece comprising an earpiece housing comprising:

an ear canal part to be introduced into an ear canal of a user, wherein the ear canal part extends along an ear canal axis of the earpiece, the ear canal part having a first end configured to be positioned in the ear canal of the user;

a first protrusion with a first outer surface; and a second protrusion with a second outer surface; and an intermediate space between the first protrusion and the second protrusion;

wherein the first protrusion is between the first end of the ear canal part and the second protrusion along the ear canal axis, the first protrusion comprising a first channel part configured to provide fluid communication between an ear canal cavity and the intermediate space, the second protrusion comprising a second channel part configured to provide fluid communication between the intermediate space and a surrounding of the user; and wherein the hearing device has a first hearing device end, and a second hearing device end opposite from the first hearing device end, the second hearing device end configured to face an environment outside the user when the hearing device is worn by the user, and wherein the second protrusion comprising the second channel part is located closer to the second hearing device end than to the first hearing device end.

26. The earpiece according to claim 25, wherein the intermediate space is circumferentially surrounded by a material of the earpiece housing.

27. The earpiece according to claim 25, wherein the first channel part has a first diameter in a range of 0.5 mm to 5 mm, and the second channel part has a second diameter in a range of 0.5 mm to 5 mm, and wherein the second diameter is larger than the first diameter.

28. The earpiece according to claim 25, wherein a length of the intermediate space is larger than a length of the first channel part and/or a length of the second channel part.

29. The earpiece according to claim 28, wherein the length of the intermediate space is larger than a sum of the length of the first channel part and the length of the second channel part.

30. The earpiece according to claim 25, wherein the earpiece housing comprises a wall that is integral with the first protrusion and with the second protrusion.

31. The earpiece according to claim 25, wherein the earpiece housing having the first and second protrusions is at least partly customized.

* * * * *